United States Patent [19]

Onishi

[11] 4,180,029

[45] Dec. 25, 1979

[54] 2-CYCLE ENGINE OF AN ACTIVE THERMOATMOSPHERE COMBUSTION

[75] Inventor: Sigeru Onishi, Kanazawa, Japan

[73] Assignee: Toyota Jidosha Kogyo Kabushiki Kaisha, Toyota, Japan

[21] Appl. No.: 861,947

[22] Filed: Dec. 19, 1977

[30] Foreign Application Priority Data

Dec. 29, 1976 [JP] Japan ..... 51-158047
Oct. 11, 1977 [JP] Japan ..... 52-120895

[51] Int. Cl.[2] ..... F02B 25/20

[52] U.S. Cl. ..... 123/73 A; 123/73 PP; 123/65 EM

[58] Field of Search ..... 123/73 R, 73 A, 73 PP, 123/73 SP, 65 P, 65 PE, 65 EM, 65 PD, DIG. 3

[56] References Cited

U.S. PATENT DOCUMENTS

| | | | |
|---|---|---|---|
| 1,001,404 | 8/1911 | Holloway | 123/73 A |
| 1,360,383 | 11/1920 | Edwards | 123/73 A |
| 1,780,635 | 11/1930 | Spencer . | |
| 2,406,491 | 8/1946 | De Waern | 123/73 A |
| 3,817,227 | 6/1974 | Onishi | 123/73 A |
| 3,823,702 | 7/1974 | Roberts | 123/188 M |
| 3,915,524 | 7/1975 | Heindner . | |
| 3,929,111 | 12/1975 | Turner et al. | 123/73 PP |
| 4,075,985 | 2/1978 | Iwai | 123/73 A |

FOREIGN PATENT DOCUMENTS

| | | | |
|---|---|---|---|
| 20146 | 4/1915 | Denmark | 123/73 A |
| 485707 | 10/1929 | Fed. Rep. of Germany | 123/73 A |
| 17176 | 5/1956 | Fed. Rep. of Germany | 123/73 R |
| 1037757 | 8/1958 | Fed. Rep. of Germany | 123/73 R |
| 1115524 | 10/1961 | Fed. Rep. of Germany | 123/73 A |
| 1251999 | 10/1967 | Fed. Rep. of Germany | 123/73 R |
| 494602 | 9/1919 | France | 123/73 A |
| 83220 | 3/1954 | Norway | 123/73 A |

*Primary Examiner*—Charles J. Myhre
*Assistant Examiner*—David D. Reynolds
*Attorney, Agent, or Firm*—Stevens, Davis, Miller & Mosher

[57] ABSTRACT

Disclosed is a 2-cycle engine having a scavenging passage communicating the crank case with the combustion chamber. The scavenging passage comprises a first passage and a second passage. The first passage has a long length and a small cross-sectional area for causing a fresh combustible mixture to flow at a high speed. The second passage has a short length and a large cross-sectional area for causing a fresh combustible mixture to flow at a low speed. The vaporization of the fresh combustible mixture is prometed in the first passage and, in addition, the fresh combustible mixture flows into the combustion chamber at a low speed. As a result of this, an active thermoatmosphere combustion is caused in the combustion chamber.

35 Claims, 15 Drawing Figures

2-CYCLE ENGINE OF AN ACTIVE THERMOATMOSPHERE COMBUSTION

DESCRIPTION OF THE INVENTION

The present invention relates to a method of active thermoatmosphere combustion in a 2-cycle engine and to a 2-cycle engine of an active thermoatmosphere combustion type.

With regard to a 2-cycle engine, it has been known that self ignition of the fresh combustible mixture can be caused in the combustion chamber of an engine without the fresh combustible mixture being ignited by the spark plug. The combustion caused by the above-mentioned self ignition is conventionally called an extraordinary combustion or a run on. When the engine is operating at a high speed under a light load, wherein the above-mentioned extraordinary combustion is caused, the amount of residual exhaust gas remaining in the cylinder of the engine is much larger than that of the fresh combustible mixture fed into the cylinder. Therefore, the fresh combustible mixture fed into the cylinder is heated until it is reformed by the residual exhaust gas, which has a high temperature, and as a result, the fresh combustible mixture produces radicals. An atmosphere wherein radicals are produced as mentioned above is hereinafter called an active thermoatmosphere. However, when an extraordinary combustion is caused, the active thermoatmosphere is extinguished at the beginning of the compression stroke, and hot spot ignition, mis-fire and detonation caused by a spark plug are alternately repeated, thus, causing a great fluctuation of torque. Since the extraordinary combustion has drawbacks in that a great fluctuation torque occurs as mentioned above, such an extraordinary combustion is conventionally considered an undesirable combustion.

The inventor conducted research on extraordinary combustion and, as a result, has proven that, if the active thermoatmosphere which is caused in the extraordinary combustion at the beginning of the compression stroke can continue to be maintained until the end of the compression stroke, self ignition of the active thermoatmosphere is caused in the combustion chamber of an engine without the thermoatmosphere being ignited by the spark plug and, then, the active thermoatmosphere combustion takes place. In addition, the inventor has further proven that this active thermoatmosphere combustion results in quiet engine operation and can be caused even if a lean air-fuel mixture is used. This results in a considerable improvement in fuel consumption and a considerable reduction in the amount of harmful components in the exhaust gas. An example of a 2-cycle engine capable of causing such an active thermoatmosphere is disclosed in the Japanese Patent Application No. 52-94133, filed by the same inventor.

An object of the present invention is to provide the improvements to the 2-cycle engine disclosed in the above-mentioned Japanese Patent Application, and particularly to provide a combustion method and a 2-cycle engine which is suited to be operated under a partial load for a long time.

According to the present invention, there is provided a method of combustion in a 2-cycle engine having a crank room, a combustion chamber and a scavenging passage communicating the crank room with the combustion chamber, said method comprising the steps of: introducing a fresh combustible mixture into the crank room; leading the fresh combustible mixture in the crank room into the scavenging passage; causing the fresh combustible mixture to flow at a high speed in the scavenging passage for promoting the vaporization of the liquid fuel contained in the fresh combustible mixture; causing the fresh combustible mixture to flow at a low speed in the scavenging passage; feeding the fresh combustible mixture into the combustion chamber at a low speed while suppressing the flow and turbulence of the burned gas in the combustion chamber and preventing the dissipation of the heat of the burned gas in the combustion chamber for maintaining the residual burned gas in the combustion chamber at a high temperature; creating an active thermoatmosphere in the combustion chamber at the beginning of the compression stroke; continuing to maintain the active thermoatmosphere until the end of the compression stroke, and reforming the fresh combustible mixture, and; causing self-ignition of the fresh combustible mixture. In addition, according to the present invention, there is provided a 2-cycle engine comprising: a cylinder having a cylinder bore and a crank room therein; a piston reciprocally movable in said cylinder bore, said piston and said cylinder bore defining a combustion chamber; an intake passage having mixture forming means therein for introducing a fresh combustible mixture into said crank room; first scavenging passage means connected to said crank room for causing the fresh combustible mixture to flow at a high speed; second scavenging passage means communicating said first scavenging passage means with a scavenging port opening into said combustion chamber for causing the fresh combustible mixture to flow at a low speed, and; an exhaust passage having an exhaust port opening into said combustion chamber for discharging exhaust gas to the atmosphere.

The present invention may be more fully understood from the description of preferred embodiments of the invention set forth below, together with the accompanying drawings.

DESCRIPTION OF PREFERRED EMBODIMENTS

Figure 1:
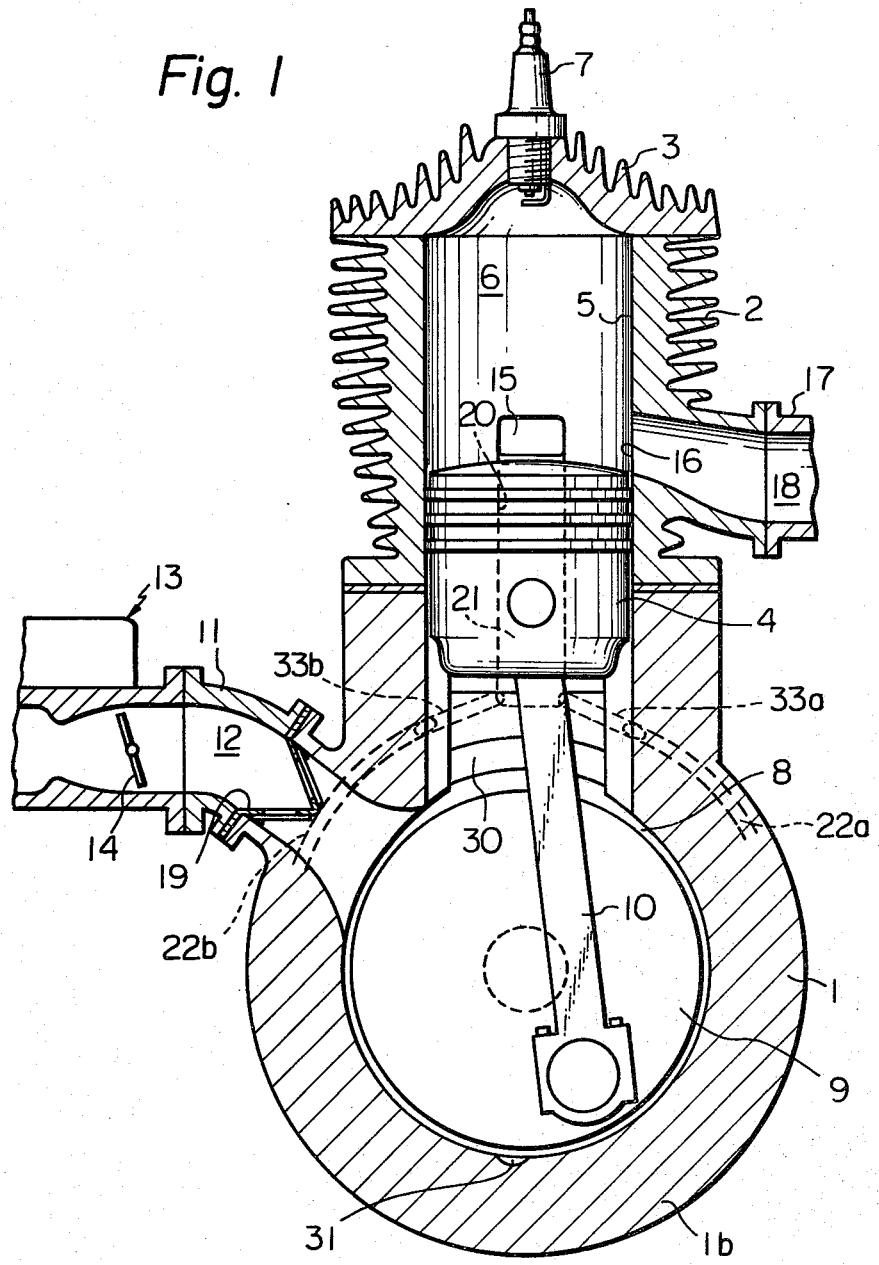
FIG. 1 is a cross-sectional side view of an embodiment of a 2-cycle engine according to the present invention.
Figure 2:
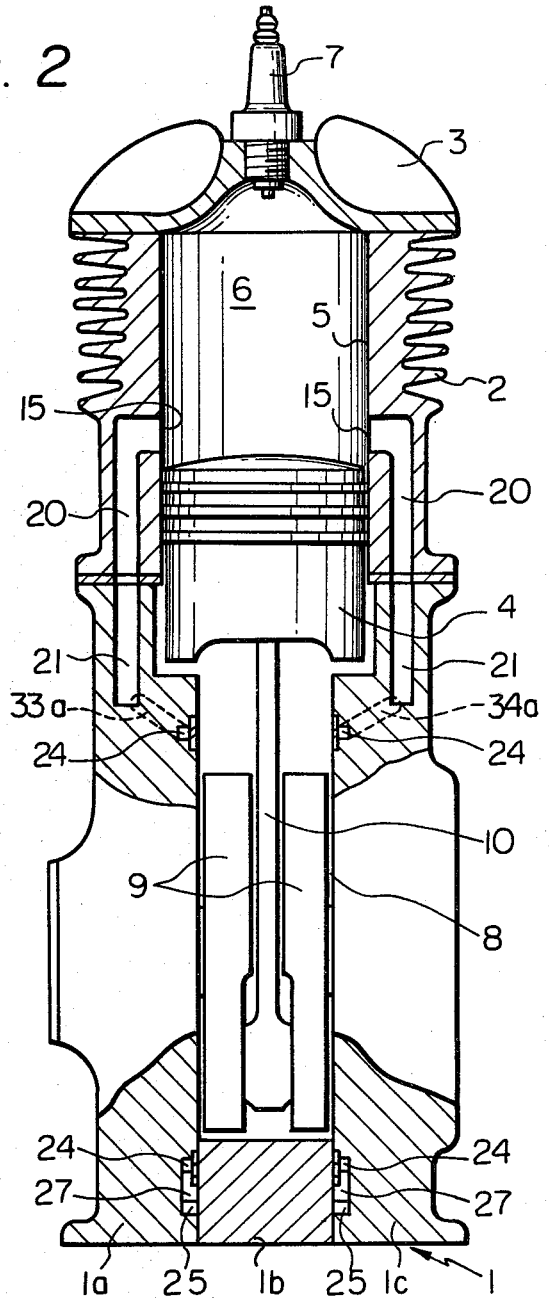
FIG. 2 is a cross-sectional side view of the engine shown in FIG. 1.
Figure 3:
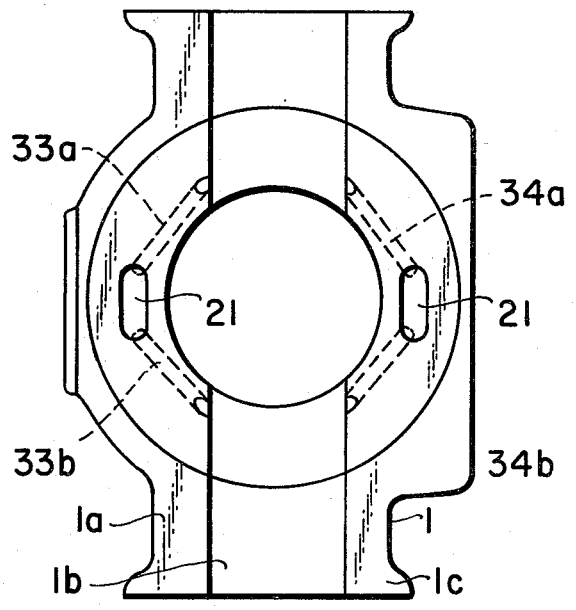
FIG. 3 is a plan view of a crank case.

Referring to FIGS. 1 and 2, 1 designates a crank case, 2 a cylinder block fixed onto the crank case, 3 a cylinder head fixed onto the cylinder block 2, 4 a piston having an approximately flat top face and reciprocally moving in a cylinder bore 5 formed in the cylinder block 2 and 6 a combustion chamber formed between the cylinder head 3 and the piston 4; 7 designates a spark plug, 8 a crank room formed in the crank case 1 and 9 a balance weight; 10 designates a connecting rod, 11 an intake pipe, 12 an intake passage and 13 a carburetor; 14 designates a throttle valve of the carburetor 13, 15 a pair of scavenging ports, 16 an exhaust port; 17 designates an exhaust pipe, 18 an exhaust passage and 19 a reed valve which permits the inflow of a fresh combustible mixture into the crank room 8 from the intake passage 12. The embodiment shown in FIGS. 1 and 2 shows a Schnurle type 2-cycle engine having an effective compression ratio of 6.5:1. As is shown in FIG. 2, the crank case 1 comprises three crank case parts 1*a*, 1*b* and 1*c*. A pair of scavenging passages 20, each of which opens into the combustion chamber 6 at the scavenging port 15, is formed in the cylinder block 1, and the scavenging passages 20 are connected to corresponding scavenging passages 21, each of which is formed on the upper portion of the crank case 1 and aligned with the respective scavenging passage 20. The scavenging passage consisting of the scavenging passages 20 and 21 is hereinafter referred to as a second scavenging passage.

Figure 4:
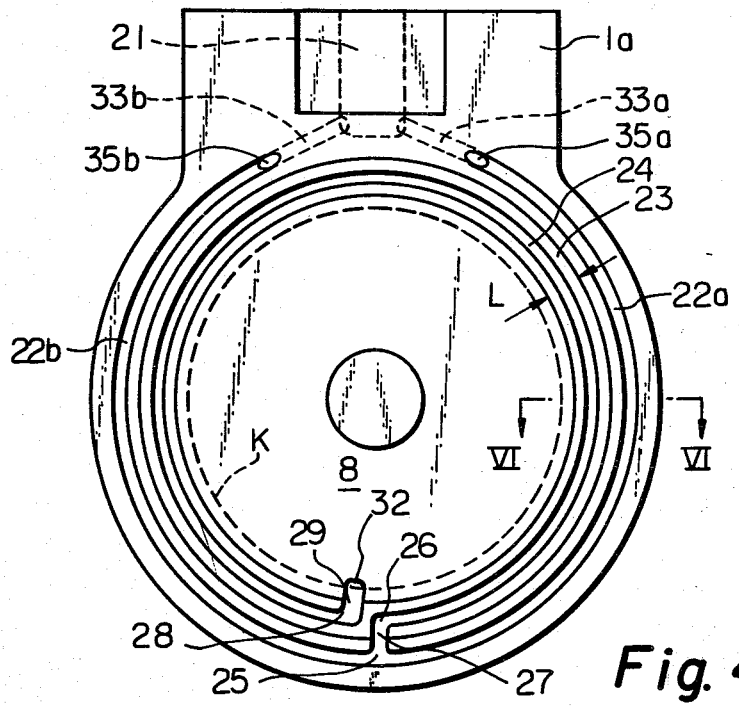
FIG. 4 is a front view of the crank case part 1*a;*
Figure 5:
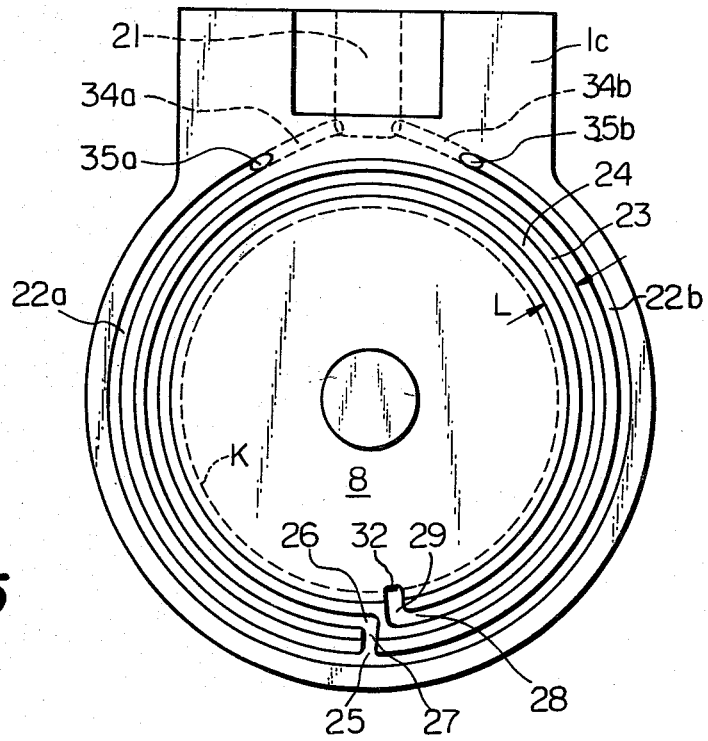
FIG. 5 is a front view of the crank case part 1*b;*

FIG. 4 shows the inner wall of the crank case part 1*a*, and FIG. 5 shows the inner wall of the crank case part 1*c*. Referring to FIGS. 4 and 5, a pair of grooves 22*a* and 22*b* is formed on the inner wall of the crank case part 1*a*, 1*c* and arranged to extend along the circular periphery thereof. A shallow annular groove 23 having a fixed width L is formed on the inner wall of the crank case part 1*a*, 1*b* at a position located inward of the grooves 22*a* and 22*b* and, in addition, a groove 24 extending along the annular groove 23 is formed on the central portion of the bottom face of the annular groove 23. In FIGS. 4 and 5, the broken line K indicates the outer contour of the crank room 8. Consequently, when the crank case parts 1*a*, 1*b* and 1*c* are assembled to form the crank case 1, all of the grooves 22*a*, 22*b*, 23 and 24 are positioned between the crank case part 1*b* and the crank case part 1*a*, 1*c*. As is shown in FIGS. 4 and 5, the grooves 22*a* and 22*b* are joined with each other at the lowest portion 25 thereof. One end 26 of the groove 24 is in communication with the lowest portion 25 of the grooves 22*a* and 22*b* via a vertical short groove 27, while the other end 28 of the groove 24 is connected to a vertical short groove 29, the top of which opens into the crank room 8. An annular plate 30(FIG. 6) is fitted into the annular groove 23 so that the groove 24 is covered by the annular plate 30.

Figure 6:
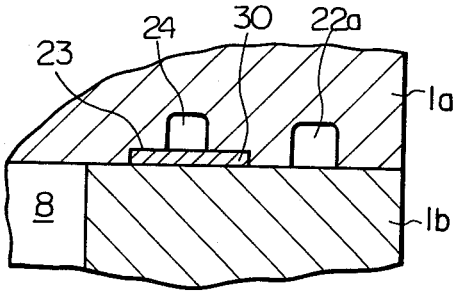
FIG. 6 is a cross-sectional view taken along the line VI—VI in FIG. 4.
Figure 7:
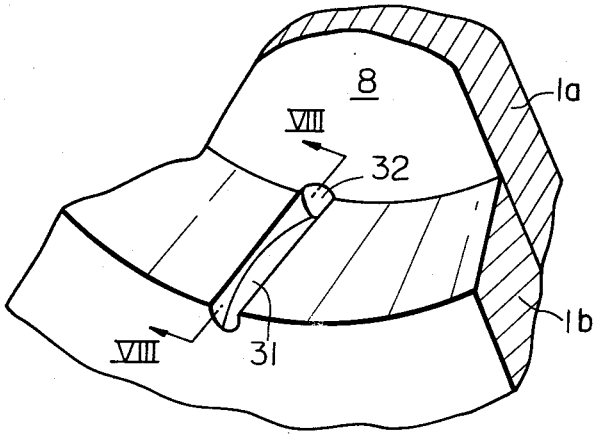
FIG. 7 is a perspective view of the bottom of the crank room.
Figure 8:
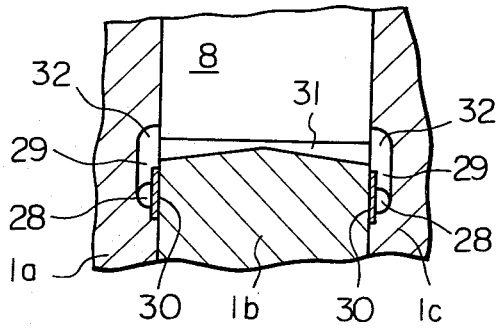
FIG. 8 is a cross-sectional view taken along the line VIII—VIII in FIG. 7.

FIG. 6 shows a cross-sectional view taken along the line VI—VI in FIG. 4 in the case wherein the crank case parts 1*a* and 1*b* are assembled. From FIGS. 4 and 6, it will be understood that, when the crank case parts 1*a*, 1*b* and 1*c* are assembled, to form the crank case 1, each of the grooves 22*a*, 22*b*, 24, 27 and 29 forms a passage. As is shown in FIG. 7, a groove 31 is formed on the inner wall of the crank case part 1*b*, which defines the bottom of the crank room 8, and the top 32 of the vertical short groove 29 opens into the end of the groove 31. As is shown in FIG. 8, the bottom face of the groove 31 is formed so as to be inclined downwards from the central portion to the opposite ends thereof.

As is shown by the broken lines in FIGS. 1 through 5, a pair of passages 33*a*, 33*b* and 34*a*, 34*b* opening into the corresponding scavenging passages 21 is formed in the crank case parts 1*a*, 1*c*. The lower ends of the passages 33*a*, 33*b* and 34*a*, 34*b* are connected to the corresponding upper ends 35*a*, 35*b* (FIGS. 4 and 5) of the grooves 22*a* and 22*b* which are formed on the inner wall of the crank case part 1*a*, 1*c*, so that a relatively smooth connection is established between the passages 33*a*, 33*b* and 34*a*, 34*b*, and the grooves 22*a* and 22*b*. The pair of passages 33*a*, 33*b* and 34*a*, 34*b* is so arranged that the axes of the passage 33*a*, 34*a* and the passage 33*b*, 34*b* intersect with each other at an angle. Thus, the passages 33*a*, 33*b* and 34*a*, 34*b* open into the opposite ends of the lowest interior portion of the scavenging passage 21 so that, as is hereinafter described in detail, the streams of the fresh combustible mixture flowing out from the passages 33*a*, 33*b* and 34*a*, 34*b* come into violent contact with each other, thereby reducing the velocity of the fresh combustible mixture stream.

As it will be understood from the above description, each of the scavenging passages 21 is connected to the crank room 8 via the passages 33*a*, 33*b* and 34*a*, 34*b*, the grooves 22*a*, 22*b*, the vertical short groove 27, the groove 24 and the vertical short groove 29. The passage consisting of the passages 33*a*, 33*b* and 34*a*, 34*b*, the grooves 22*a*, 22*b*, the vertical short groove 27, the groove 24 and the vertical short groove 29 is hereinafter referred to as a first scavenging passage. Consequently, it will be understood that the crank room 8 is connected to the combustion chamber 6 via the above-mentioned first scavenging passage and the second scavenging passage mentioned previously.

In operation, the fresh combustible mixture introduced into the crank room 8 from the intake passage 12 via the reed valve 19 is gradually compressed in accordance with the downward movement of the piston 4 and, thus, the fresh combustible mixture is forced into the first scavenging passage from the vertical short groove 29. Then, the fresh combustible mixture introduced into the first scavenging passage flows at a high speed in the first connecting passage because the first scavenging passage has a small cross-sectional area. After this, the fresh combustible mixture flows into the second scavenging passage. Since the fresh combustible mixture is caused to flow at a high speed in the first scavenging passage, due to the fact that the first scavenging passage has a small cross-sectional area as mentioned above, the flow energy is added to the fresh combustible mixture and, as a result, the vaporization of the liquid fuel continues to be promoted during this time. After the vaporization of the fresh combustible mixture is sufficiently promoted, the fresh combustible mixture in the first scavenging passage flows into the second scavenging passage. At this time, as mentioned previously, since the streams of the fresh combustible mixture flowing out from the passages 33*a*, 33*b* and 34*a*, 34*b* come into violent contact with each other in the scavenging passage 21 and lose kinetic energy and, in addition, the scavenging passage 21 has a cross-sectional area which is considerably larger than those of the passages 33*a*, 33*b* and 34*a*, 34*b*, the fresh combustible mixture flowing into the scavenging passage 21 from the passages 33*a*, 33*b* and 34*a*, 34*b* is abruptly decelerated. After this, the fresh combustible mixture moves upward at a low speed in the scavenging passages 21 and 20, having smooth inner walls, and then, flows into the combustion chamber 6 at a low speed when the piston 4 opens the scavenging ports 15. Even if the pressure in the crank room 8 is considerably higher than that in the combustion chamber 6 when the piston 4 opens the scavenging ports 15 to permit the inflow of the fresh combustible mixture into the combustion chamber 6, since the first scavenging passage functions as throttling means because it has a small cross-sectional area, the fresh combustible mixture can not flow into the combustible chamber 6 at a high speed. As a result of this, the flow velocity of the fresh combustible mixture is low throughout the inflow operation of the fresh combustible mixture. Consequently, when the fresh combustible mixture flows into the combustion chamber 6, the flow of the residual burned gas in the combustion chamber 6 is extremely small and, as a result, the dissipation of the heat of the residual burned gas is prevented. In addition, at the beginning of the compression stroke under a partial load of the engine, a large amount of the residual burned gas is present in the combustion chamber 6. Since the amount of the residual burned gas in the combustion chamber 6 is large and, in addition, the residual burned gas has a high temperature, the fresh combustible mixture is heated until radicals are produced and, as a result, an active thermoatmosphere is created in the combustion chamber 5. Further, since the flow of the gas in the combustion chamber 6 is extremely small during the compression stroke, the occurrence of turbulence and the loss of heat energy escaping into the inner wall of the combustion chamber 6 are restricted to the smallest possible extent. Consequently, the temperature of the gas in the combustion chamber 6 is further increased as the compressing operation progresses and, as a result, the amount of radicals produced in the combustion chamber 6 is further increased. When the radicals are produced, the combustion which is called a preflame reaction has been started. After this, when the temperature of the gas in the combustion chamber 6 becomes high at the end of the compression stroke, a hot flame generates to cause the self ignition which is not caused by the spark plug 7. Then, the gentle combustion is advanced while being controlled by the residual burned gas. When the piston 4 moves downwards and opens the exhaust port 16, the burned gas in the combustion chamber 6 is discharged into the exhaust passage 18.

In order to cause the active thermoatmosphere combustion, it is necessary, firstly, to cause the high speed flow of the fresh combustible mixture in the first scavenging passage so as to fully vaporize the liquid fuel, and; secondly, to cause a great deceleration of the fresh combustible mixture so as to flow the fresh combustible mixture into the combustion chamber 6 at a low speed. In order to cause the high speed flow of the fresh combustible mixture in the first scavenging passage, as is shown in FIGS. 4 and 5, the grooves 22*a*, 22*b* and 24 are formed by a long passage having a small cross-section. In addition, while in order to cause the high speed flow of the fresh combustible mixture, it is preferable that the first scavenging passage be formed as smoothly as possible, according to the experiments conducted by the inventor, it has been proven that a satisfactory high speed flow of the fresh combustible mixture can be obtained even if a sharply turning portion of the passage such as the connecting portion of the groove 24 and the grooves 22*a*, 22*b* or the connecting portion of the groove 24 and the vertical short groove 29, is formed at a position remote from the scavenging passage 21.

When the fresh combustible mixture flows into the combustion chamber 6 from the scavenging ports 15, the radicals are produced in the vapor phase within the contact region of the fresh combustible mixture and the residual burned gas. However, in the case wherein the fresh combustible mixture comes into contact with the inner wall of the combustion chamber 6, the radicals are not produced in the contact region of the fresh combustible mixture and the inner wall of the combustion chamber 6. Consequently, as a type of a 2-cycle engine, it is preferable to adopt a Schnurle type 2-cycle engine having a pair of the scavenging ports 15 which are arranged so that the streams of the fresh combustible mixture flowing into the combustion chamber 6 from the scavenging ports 15 come into contact with each other and, as a result, the fresh combustible mixture is collected at the central portion of the combustion chamber 6 and enclosed by the residual burned gas. However, a 2-cycle engine of any other type may be used, if it has such a construction that the fresh combustible mixture is enclosed by the residual burned gas.

The fresh combustible mixture sucked into the crank room 8 from the intake passage 12 when the piston 4 moves upward contains a large amount of the liquid fuel. This liquid fuel is gathered on the bottom of the crank room 8 after it is sucked into the crank room 8. However, in the case wherein the open end of the first scavenging passage opens into the bottom of the crank room 8, as in the present invention, since the liquid fuel gathered on the bottom of the crank room 8 is forced into the first scavenging passage together with the air-fuel mixture it is possible to supply the combustion chamber 6 with the fuel in an amount which varies precisely in response to the load of the engine, that is, in the opening degree of the throttle valve 14.

In a conventional 2-cycle engine, in order to minimize the flow resistance to which the fresh combustible mixture is subjected when the engine is operating under a heavy load, the length of the scavenging passage is shortened in such a way that the scavenging passage opens into the upper interior of the crank room. However, a conventional engine has drawbacks in that, since a large amount of the liquid fuel contained in the introduced fresh combustible mixture is gathered on the bottom of the crank room when the engine is started, the fresh combustible mixture fed into the combustion chamber becomes excessively lean, whereby a long time is necessary to cause ignition of the fresh combustible mixture. In addition, a conventional engine has further drawbacks in that, since a great vacuum is produced in the crank room after ignition, the liquid fuel gathered on the bottom of the crank room is instantaneously vaporized and, as a result, an excessively rich mixture is fed into the combustion chamber, thus causing a misfire. However, in the present invention, the above-mentioned drawbacks are eliminated by arranging the first scavenging passage so as to open into the bottom of the crank room. In addition, as is shown in FIG. 7, by forming the groove 31 on the inner wall of the crank case part 1*b* at the bottom of the crank room 8, the liquid fuel gathered in the groove 31 is blown away by the air stream caused by the rotating motion of the balance weight 9. As a result of this, the vaporization of the liquid fuel in the crank room 8 is promoted. Furthermore, as is shown in FIG. 8, by forming the bottom of the groove 31 so as to be downwardly inclined towards the grooves 29, it is possible to guide the liquid fuel gathered in the groove 31 to the grooves 29.

Figure 9:
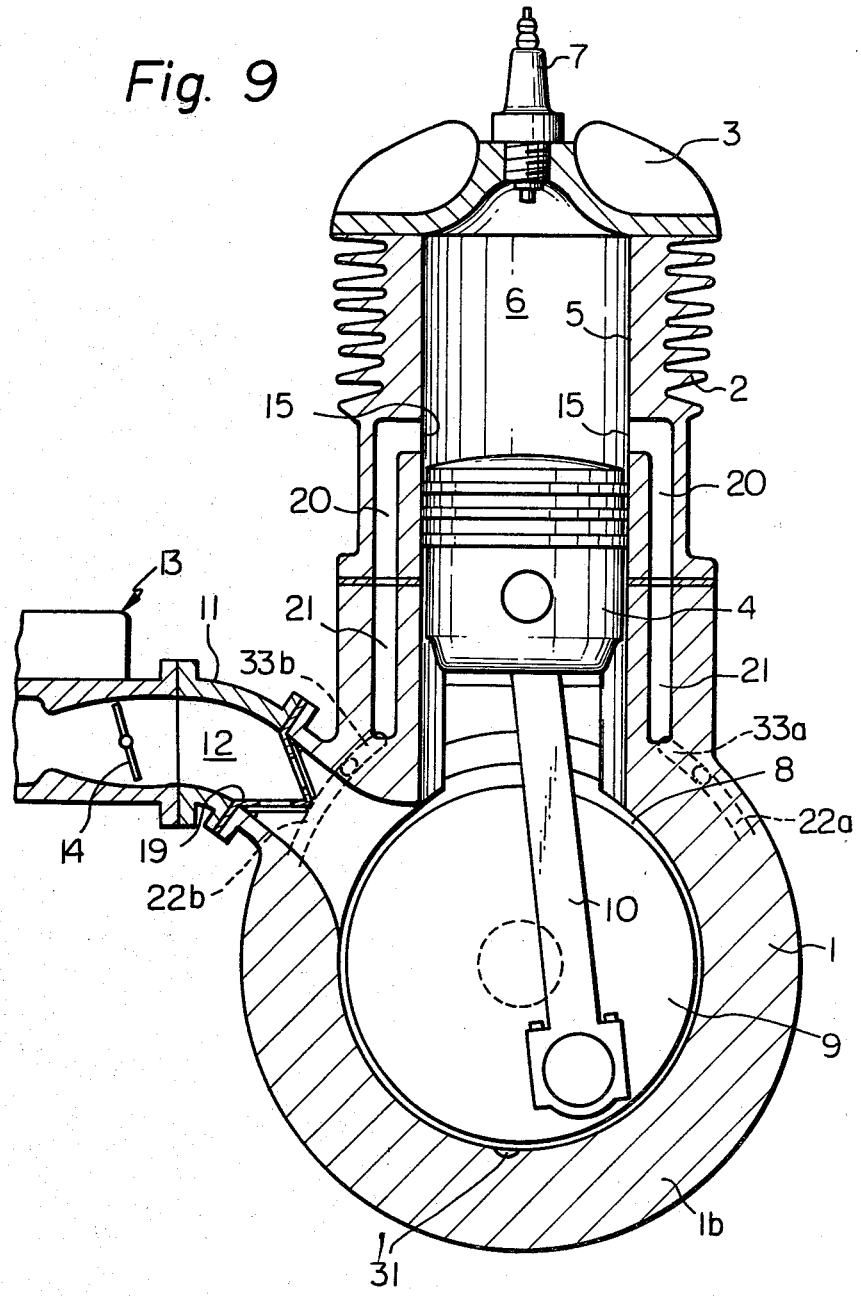
FIG. 9 is a cross-sectional side view of another embodiment according to the present invention.
Figure 10:
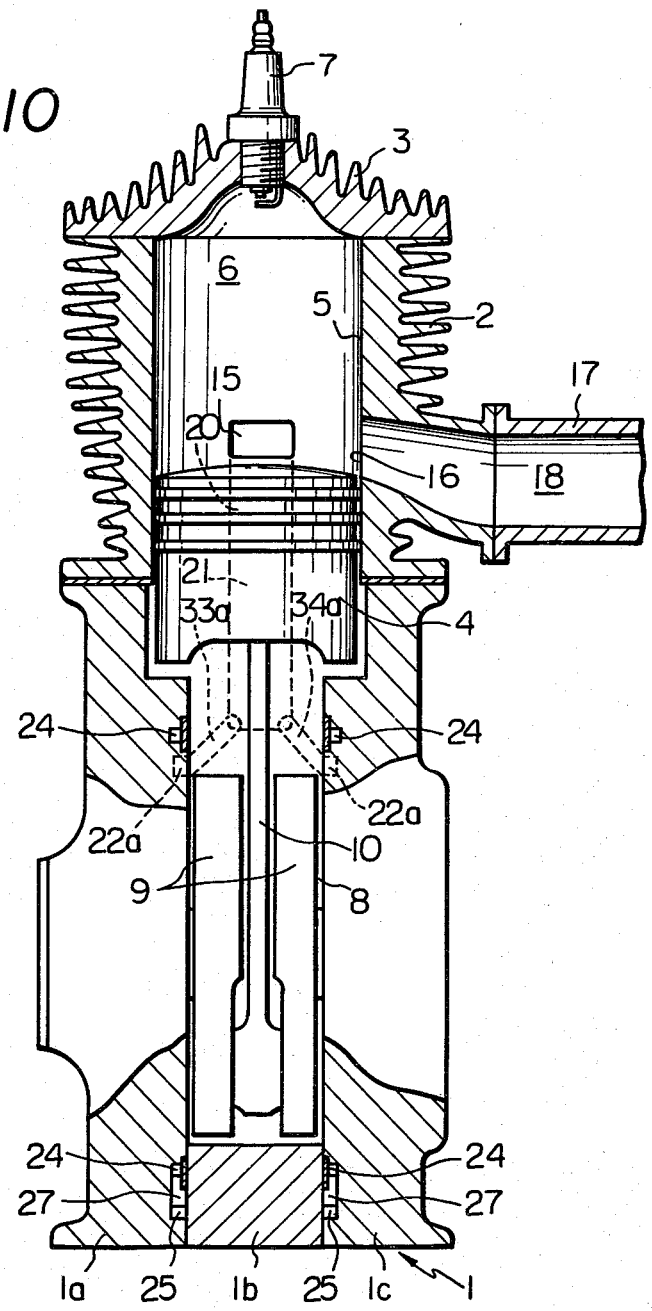
FIG. 10 is a cross-sectional side view of the engine shown in FIG. 9.
Figure 11:
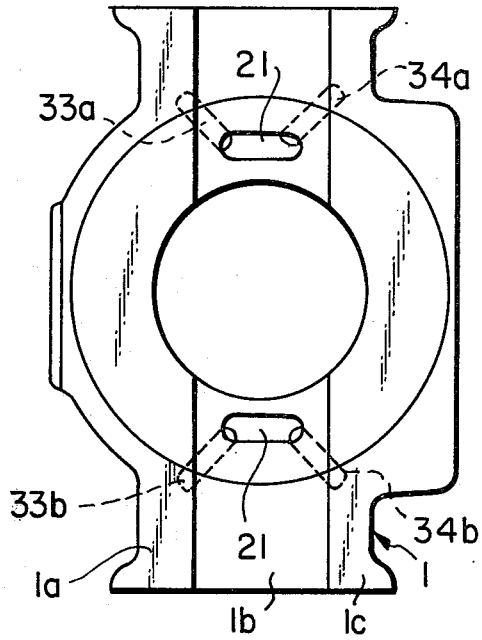
FIG. 11 is a plan view of the crank case shown in FIG. 9.
Figure 12:
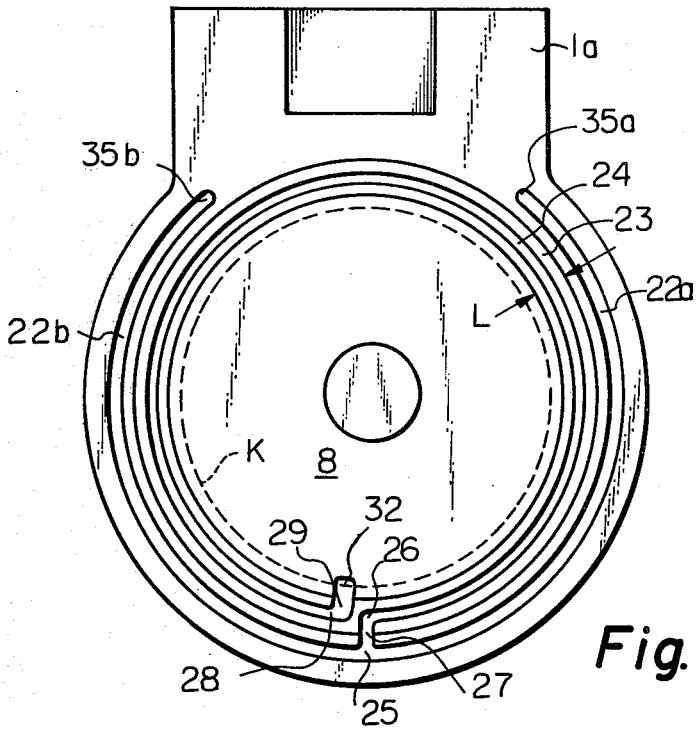
FIG. 12 is a front view of the crank case part 1*a* shown in FIG. 9.

FIGS. 9 through 12 show another embodiment according to the present invention. In FIGS. 9 through 12, similar components are indicated with the same reference numerals as used in FIGS. 1 through 5. As is shown in FIGS. 9 and 11, in this embodiment, the scavenging passage 21 is formed in the crank case part 1*b*, and the upper ends 35*a*, 35*b* of the grooves 22*a*, 22*b* formed on the crank case parts 1*a*, 1*c* are connected to the bottom interior of the scavenging passages 21 via the passages 33*a*, 33*b* and 34*a*, 34*b* formed in the crank case part 1*b*. In the same manner as described with reference to FIGS. 1 through 5, a pair of the passages 33*a*, 34*a* and 33*b*, 34*b* is so arranged that the axes of the passage 33*a*, 33*b* and the passage 34*a*, 34*b* intersect with each other at an angle and, thus, the streams of the fresh combustible mixture flowing out from the passages 33*a*, 34*a* and 33*b*, 34*b* come into violent contact with each other.

Figure 13:
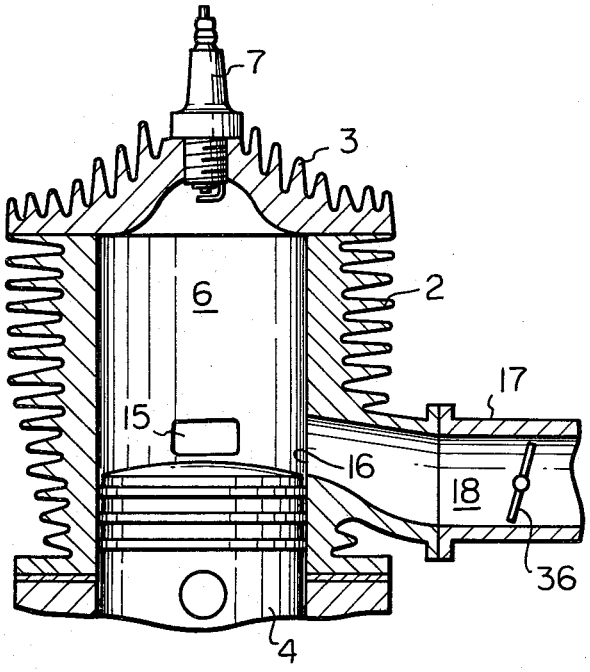
FIG. 13 is a cross-sectional side view of a further embodiment according to the present invention.
Figure 14:
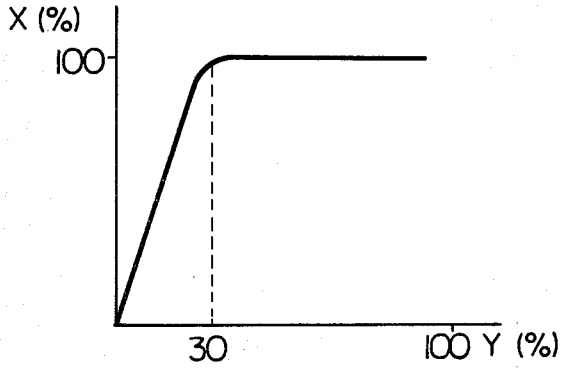
FIG. 14 is a graph showing the relationship of the opening degree between the throttle valve and the exhaust control valve.

As mentioned previously, in order to continue to maintain the active thermoatmosphere until the end of the compression stroke, it is necessary to minimize the turbulence and the flow of the residual burned gas in the combustion chamber 6. Two causes of turbulence and flow of the residual burned gas are an abrupt blowing off operation of the exhaust gas discharging from the exhaust port 16 and interference by the pulsating pressure of the exhaust gas. In order to prevent the above-mentioned abrupt blowing off operation and interference, as is shown in FIG. 13, it is preferable that an exhaust control valve 36 be disposed in the exhaust passage 18. FIG. 14 shows the relationship of the opening degree between the exhaust control valve 36 and the throttle valve 14. In FIG. 14, the ordinate X indicates a ratio of an opening area to the full opening area of the exhaust control valve 36, and the abscissa Y indicates a ratio of an opening area to the full opening area of the throttle valve 14. As is apparent from FIG. 14, the exhaust control valve 36 is gradually opened and then fully opened before the throttle valve 14 reaches a position corresponding to the opening area ratio X of approximately 30 percent. In addition, the exhaust control valve 36 remains fully opened when the throttle valve 14 is further opened.

Figure 15:
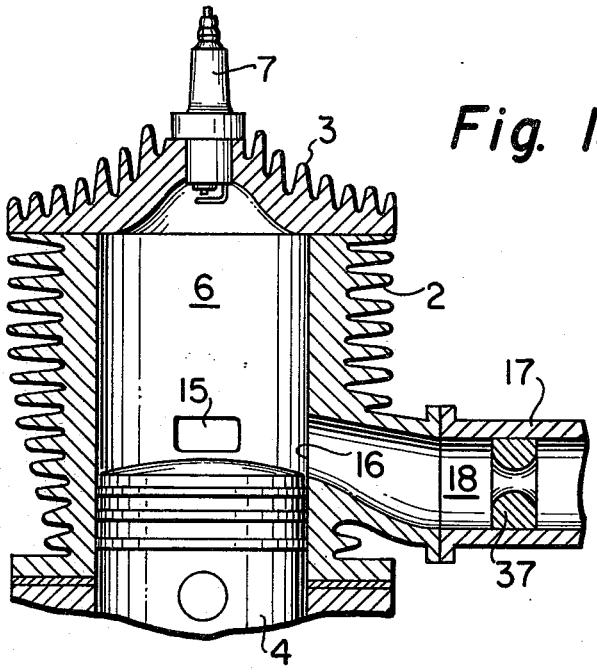
FIG. 15 is a cross-sectional side view of a still further embodiment according to the present invention.

In addition, in the case wherein the engine is operated only under a light load, as is shown in FIG. 15, a restricting member 37 having a fixed restricted opening area may be disposed in the exhaust passage 18. In addition, in order to appropriately prevent the exhaust gas from being abruptly discharged from the exhaust port 16, it is preferable that the volume of the exhaust passage 18 located between the exhaust port 16 and the exhaust control valve 36 be smaller than that of the combustion chamber 6 when the piston is positioned at the bottom dead center. In an engine according to the present invention, the spark plug 7 is used at the time of the warm-up of the engine and when the engine is operating under a heavy load, and it is not necessary to use the spark plug 7 when the engine is operating under a partial load wherein the active thermoatmosphere combustion is carried out.

A 2-cycle engine according to the present invention is suitable to be operated under a partial load and, according to the present invention, a quiet operation of the engine can be obtained. In addition, the active thermoatmosphere combustion causes a large reduction in the amount of harmful components in the exhaust gas and, also, causes a considerable improvement in the fuel consumption.

While the invention has been described by reference to specific embodiments chosen for purposes of illustration, it should be apparent that numerous modifications could be made thereto by those skilled in the art without departing from the spirit and scope of the invention.

What is claimed is:

1. A method of combustion in a 2-cycle engine having a crank room, a combustion chamber and a scavenging passage communicating the crank room with the combustion chamber, said method comprising the steps of:
   - introducing a fresh combustible mixture into the crank room;
   - leading the fresh combustible mixture in the crank room into the scavenging passage;
   - flowing the fresh combustible mixture from the crank room at a first high speed for a long time in a first substantially long section of the scavenging passage remote from the combustion chamber for promoting the vaporization of the liquid fuel contained in the fresh combustible mixture;
   - flowing the fresh combustible mixture at a second speed slower than the first speed in a second section of the scavenging passage downstream of the first section and substantially shorter than it;
   - feeding the fresh combustible mixture from the second section into the combustion chamber at at most the lower speed while suppressing the flow and turbulence of the burned gas in the combustion chamber and preventing the dissipation of the heat of the burned gas in the combustion chamber for maintaining the residual burned gas in the combustion chamber at a high temperature;
   - creating an active thermoatmosphere in the combustion chamber at the beginning of the compression stroke;
   - continuing to maintain the active thermoatmosphere until the end of the compression stroke, and reforming the fresh combustible mixture; and
   - causing self-ignition of the fresh combustible mixture.

2. A method as claimed in claim 1, wherein the fresh combustible mixture flowing in the scavenging passage at a high speed is abruptly decelerated for reducing the flow velocity of the fresh combustible mixture.

3. A method as claimed in claim 1, wherein and streams of the fresh combustible mixture come into violent contact with each other to cause the abrupt deceleration of the fresh combustible mixture.

4. A method as claimed in claim 1, wherein the fresh combustible mixture flows into a space having a large volume to cause the abrupt deceleration of the fresh combustible mixture.

5. A method as claimed in claim 1, wherein the fresh combustible mixture flows at the first speed for a long distance in the first section of the scavenging passage and flows at the second speed for a shorter distance in the second section of the scavenging passage.

6. A method as claimed in claim 5, wherein the fresh combustible mixture smoothly flows at the first speed in the of the scavenging passage.

7. A method as claimed in claim 6, wherein the fresh combustible mixture smoothly flows at the first speed over the entire length of the first section the scavenging passage.

8. A method as claimed in claim 6, wherein the fresh combustible mixture smoothly flows at the second speed in the second section of the scavenging passage after the fresh combustible mixture is decelerated.

9. A method as claimed in claim 1, wherein the fresh combustible mixture in the crank room is forced into the scavenging passage at the bottom interior of the crank room.

10. A method as claimed in claim 9, wherein the liquid fuel gathered on the bottom interior of the crank room is guided to the scavenging passage.

11. A method as claimed in claim 1, wherein the abrupt outflow of the exhaust gas from the combustion chamber is restricted for surpressing the flow and turbulence of burned gas in the combustion chamber so as to maintain the residual burned gas at a high temperature.

12. A method as claimed in claim 11, wherein the restricting operation of the outflow of the exhaust gas is carried out when an engine is operating under a partial load.

13. A method as claimed in claim 1, wherein the fresh combustible mixture is fed into the combustion chamber towards the central portion thereof.

14. A 2-cycle engine comprising:

a cylinder having a cylinder bore and a crank room therein;

a piston reciprocally movable in said cylinder bore, said piston and said cylinder bore defining a combustion chamber;

an intake passage having mixture forming means therein for introducing a fresh combustible mixture into said crank room;

first scavenging passage means connected at one end to said crank room for causing the fresh combustible mixture to flow at a high speed;

second scavenging passage means connected at one end and continuously open to the other end of said first scavenging passage means with a scavenging port opening into said combustion chamber for causing the fresh combustible mixture to flow at a low speed, said second scavenging passage means being substantially shorter than and of substantially greater transverse cross-sectional area than said first scavenging passage means; and an exhaust passage having an exhaust port opening into said combustion chamber for discharging exhaust gas to the atmosphere.

15. A 2-cycle engine as claimed in claim 14, wherein said first scavenging passage means comprises at least one first scavenging passage having a long length and a small cross-sectional area, and said second scavenging passage means comprises at least one second scavenging passage having a length which is shorter than that of said first scavenging passage and having a cross-sectional area which is larger than that of said first scavenging passage.

16. A 2-cycle engine as claimed in claim 15, wherein said first scavenging passage comprises a pair of branch portions communicating said second scavenging passage with said crank room.

17. A 2-cycle engine as claimed in claim 16, wherein said first scavenging passage further comprises a single passage portion located between said branch portions and said crank room, said branch portions being branched off from said single passage portion.

18. A 2-cycle engine as claimed in claim 17, wherein said branch portions have the same length and no sharp turning portion.

19. A 2-cycle engine as claimed in claim 16, wherein said branch portions have end portions opening into the bottom interior of said second scavenging passage.

20. A 2-cycle engine as claimed in claim 19, wherein axes of the end portions of said branch portions intersect with each other at an angle so that streams of the fresh combustible mixture flowing out from the end portions of said branch portions come into violent contact with each other.

21. A 2-cycle engine as claimed in claim 15, wherein said cylinder comprises at least two crank case parts and said first scavenging passage is a groove formed on an inner wall of one of said crank case parts.

22. A 2-cycle engine as claimed in claim 21, wherein said groove is formed between said crank case parts.

23. A 2-cycle engine as claimed in claim 21, wherein said groove extends along the circular periphery of the inner wall of said crank case part.

24. A 2-cycle engine as claimed in claim 23, wherein said groove comprises a first part extending along the circular periphery of the inner wall of said crank case part, and a second part extending along said first part.

25. A 2-cycle engine as claimed in claim 15, wherein said first scavenging passage means comprises a pair of said first scavenging passages and said second scavenging passage means comprises a pair of said second scavenging passages.

26. A 2-cycle engine as claimed in claim 25, wherein each of said first scavenging passages comprises a pair of branch passages, one of the branch passages of one of said first scavenging passages and one of the branch passages of the other first scavenging passage being connected to one of said second scavenging passages, the remaining branch passages being connected to the other second scavenging passage.

27. A 2-cycle engine as claimed in claim 15, wherein said first scavenging passage has an opening which opens into the bottom interior of said second scavenging passage, the opening of said first scavenging passage being directed to a circumferential inner wall of said second scavenging passage.

28. A 2-cycle engine as claimed in claim 14, wherein said first scavenging passage means has at least one mixture inlet opening into the bottom interior of said crank room.

29. A 2-cycle engine as claimed in claim 28, wherein a groove is formed on an inner wall of said crank room at the bottom thereof, said mixture inlet opening into said groove.

30. A 2-cycle engine as claimed in claim 29, wherein said groove has a bottom which is downwardly inclined towards said mixture inlet.

31. A 2-cycle engine as claimed in claim 14, wherein means for restricting the outflow of the exhaust gas from said exhaust port is disposed in said exhaust passage.

32. A 2-cycle engine as claimed in claim 31, wherein said restricting means comprises an exhaust control valve which is partially closed when the engine is operating under a partial load.

33. A 2-cycle engine as claimed in claim 31, wherein said restricting means comprises a restricted opening having a fixed opening area.

34. A 2-cycle engine comprising:

a plurality of crank case parts defining a cylinder having a cylinder bore and a crank room therein;

a piston reciprocally movable in said cylinder bore, said piston and said cylinder bore defining a combustion chamber;

an intake passage having mixture forming means therein for introducing a fresh combustible mixture into said crank room;

first scavenging passage means connected at one end to said crank room for causing the fresh combustible mixture to flow at a high speed, said first scavenging passage means being defined by an open groove defined in a wall of one of the crank case parts which is closed by an abutting another one of the crank case parts;

second scavenging passage means connected at one end and continuously open to the other end of said first scavenging passage means with a scavenging port opening into said combustion chamber for causing the fresh combustible mixture to flow at a low speed; and an exhaust passage having an exhaust port opening into said combustion chamber for discharging exhaust gas to the atmosphere.

35. A 2-cycle engine as claimed in claim 34, wherein:

said groove extends at least part-circumferentially around the crank room and opens thereinto at the bottom thereof.

* * * * *

UNITED STATES PATENT AND TRADEMARK OFFICE

CERTIFICATE OF CORRECTION

PATENT NO. : 4,180,029

DATED : December 25, 1979

INVENTOR(S) : Sigeru Onishi

It is certified that error appears in the above—identified patent and that said Letters Patent is hereby corrected as shown below:

On the first page of the patent, item (73), Assignee reading "Toyota Jidosha Kogyo Kabushiki Kaisha, Toyota, Japan" should read -- Toyota Jidosha Kogyo Kabushiki Kaisha, Toyota, Japan, a part interest --.

Signed and Sealed this

*Twenty-seventh* Day of *May 1980*

[SEAL]

*Attest:*

SIDNEY A. DIAMOND

*Attesting Officer*

*Commissioner of Patents and Trademarks*